US005813827A

United States Patent [19]

Nordlund et al.

[11] Patent Number: 5,813,827

[45] Date of Patent: Sep. 29, 1998

[54] APPARATUS FOR COOLING A GAS TURBINE AIRFOIL

[75] Inventors: Raymond Scott Nordlund, Orlando; Kent Goran Hultgren, Winter Park; Robert Kenmer Scott, Geneva; Zachary Sinnott, Winter Park; William Edward North, Winter Springs, all of Fla.; Steven Douglas Ward, Cincinnati, Ohio

[73] Assignee: Westinghouse Electric Corporation, Pittsburgh, Pa.

[21] Appl. No.: 843,414

[22] Filed: Apr. 15, 1997

[51] Int. Cl.[6] ..... F01D 5/18

[52] U.S. Cl. ..... 415/115; 415/116; 416/96 R; 416/97 R

[58] Field of Search ..... 415/115, 116; 416/96 R, 96 A, 97 R, 92

[56] References Cited

U.S. PATENT DOCUMENTS

| | | | |
|---|---|---|---|
| 3,094,310 | 6/1963 | Bowmer | 416/92 |
| 3,834,831 | 9/1974 | Mitchell | 416/95 |
| 4,073,599 | 2/1978 | Allen et al. | 416/97 R |
| 4,292,008 | 9/1981 | Grosjean et al. | 415/115 |
| 4,456,428 | 6/1984 | Cuvillier | 416/97 R |
| 4,474,532 | 10/1984 | Pazder | 416/97 R |
| 4,930,980 | 6/1990 | North et al. | 415/115 |
| 4,962,640 | 10/1990 | Tobery | 60/39.02 |
| 5,117,626 | 6/1992 | North et al. | 60/39.75 |
| 5,120,192 | 6/1992 | Ohtomo et al. | 416/96 A |
| 5,145,315 | 9/1992 | North et al. | 415/115 |
| 5,320,485 | 6/1994 | Bourguignon et al. | 415/115 |

FOREIGN PATENT DOCUMENTS

| | | | |
|---|---|---|---|
| 0083826 | 3/1989 | Japan | 415/115 |

OTHER PUBLICATIONS

S. C. Lau, R. D. McMillin, and J. C. Han; *Heat Transfer Characteristics of Turbulent Flow in a Square Channel with Angled Discrete Ribs;* Jun., 1990; pp. 1–9.

J. C. Han and P. Zhang; *Effect of Rib–Angle Orientation on Local Mass Transfer Distribution in a Three–Pass Rib–Roughened Channel;* Jun., 1989; pp. 1–9.

*Primary Examiner*—Edward K. Look
*Assistant Examiner*—Richard Woo
*Attorney, Agent, or Firm*—D. G. Maire

[57] ABSTRACT

An apparatus for cooling the trailing edge portion of a gas turbine vane. Two radially extending passages connected to the outer shroud direct cooling fluid to a plenum formed about mid-span adjacent the trailing edge. Two arrays of cooling fluid passages extend from the plenum. One array extends radially outward toward the outer shroud while the other array extends radially inward toward the inner shroud. The plenum distributes the cooling fluid to the two arrays of passages so that it flows radially inward and outward to manifolds formed in the inner and outer shrouds. The manifolds direct the spent cooling fluid to a discharge passage.

17 Claims, 3 Drawing Sheets

APPARATUS FOR COOLING A GAS TURBINE AIRFOIL

BACKGROUND OF THE INVENTION

The present invention relates to an airfoil for use in a gas turbine, such as for a stationary vane. More specifically, the present invention relates to an airfoil having an improved cooling air flow path.

A gas turbine employs a plurality of stationary vanes that are circumferentially arranged in rows in a turbine section. Since such vanes are exposed to the hot gas discharging from the combustion section, cooling of these vanes is of the utmost importance. Typically, cooling is accomplished by flowing cooling air through cavities formed inside the vane airfoil.

According to one approach, cooling of the vane airfoil is accomplished by incorporating one or more tubular inserts into each of the airfoil cavities so that passages surrounding the inserts are formed between the inserts and the walls of the airfoil. The inserts have a number of holes distributed around their periphery that distribute the cooling air around these passages.

According to another approach, each airfoil cavity includes a number of radially extending passages, typically three, forming a serpentine array. Cooling air, supplied to the vane outer shroud, enters the first passage and flows radially inward until it reaches the vane inner shroud. A first portion of the cooling air exits the vane through the inner shroud and enters a cavity located between adjacent rows of rotor discs. The cooling air in the cavity serves to cool the faces of the discs. A second portion of the cooling air reverses direction and flows radially outward through the second passage until it reaches the outer shroud, whereupon it changes direction again and flows radially inward through the third passage.

Cooling of the trailing edge portion of the vane is especially difficult because of the thinness of the trailing edge portion. In traditional open loop cooling systems, the cooling air is discharged from the vane internal cavity into the hot gas flow path by axially oriented passages in the trailing edge of the airfoil. In closed loop systems, the trailing edge portion of the vane airfoil may be cooled by directing the cooling air through a channel that wraps around in the trailing edge in the chord-wise direction. However, this approach results in a thick trailing edge, which is aerodynamically undesirable, and increased manufacturing complexity.

In another approach, the cooling air is directed through span-wise radial holes extending between the inner and outer shrouds, with the air flowing either radially outward from the inner shroud to the outer shroud or radially inward from the outer shroud to the inner shroud. Unfortunately, this approach suffers from several disadvantages. First, the cooling air can become sufficiently heated by the time it reaches the ends of the holes that its cooling effectiveness is inadequate, thereby resulting in over-heating of the portion of the trailing edge adjacent to the inner or outer shroud. Also, if the diameter of the holes is relatively small, the length of the holes results in an undesirably high pressure drop in the cooling air. However, reducing the pressure drop by increasing the diameter of the holes results in undesirably thick trailing edges.

Span-wise radial holes are also difficult to manufacture. If the airfoil is cast, the use of long, small diameter span-wise radial holes can result in long, unsupported, and therefore weak, casting cores. In addition, such long cooling holes makes it difficult to maintain wall thickness tolerances, and results in a long leaching time.

It is therefore desirable to provide a cooling scheme for cooling the trailing edge portion of an airfoil that overcomes the problems of previous approaches, including the minimization of both the heat up of the cooling fluid by the time it reaches the end of the cooling path and the pressure drop experienced by the fluid.

SUMMARY OF THE INVENTION

Accordingly, it is the general object of the current invention to provide a cooling scheme for cooling the trailing edge portion of an airfoil that overcomes the problems of previous approaches, including the minimization of both the heat up of the cooling fluid by the time it reaches the end of the cooling path and the pressure drop experienced by the fluid.

Briefly, this object, as well as other objects of the current invention, is accomplished in an airfoil for a gas turbine, comprising (i) a leading edge and a trailing edge, (ii) first and second ends, the first end disposed radially outward from the second end, (iii) first and second side walls, (iv) a first passage formed between the first and second sidewalls, the first passage having an inlet for receiving a flow of a cooling fluid directed to the airfoil, (v) a plenum disposed between the first and second ends, the plenum in flow communication with the first passage, (vi) a plurality of second passages in flow communication with the plenum, the second passages extending in a substantially radial direction from the plenum toward the first end, (v) a plurality of third passages in flow communication with the plenum, the third passages extending in a substantially radial direction from the plenum toward the second end.

In a preferred embodiment of the invention, the plenum is disposed at about mid-height adjacent the trailing edge of the airfoil.

DESCRIPTION OF THE PREFERRED EMBODIMENT

Figure 1:
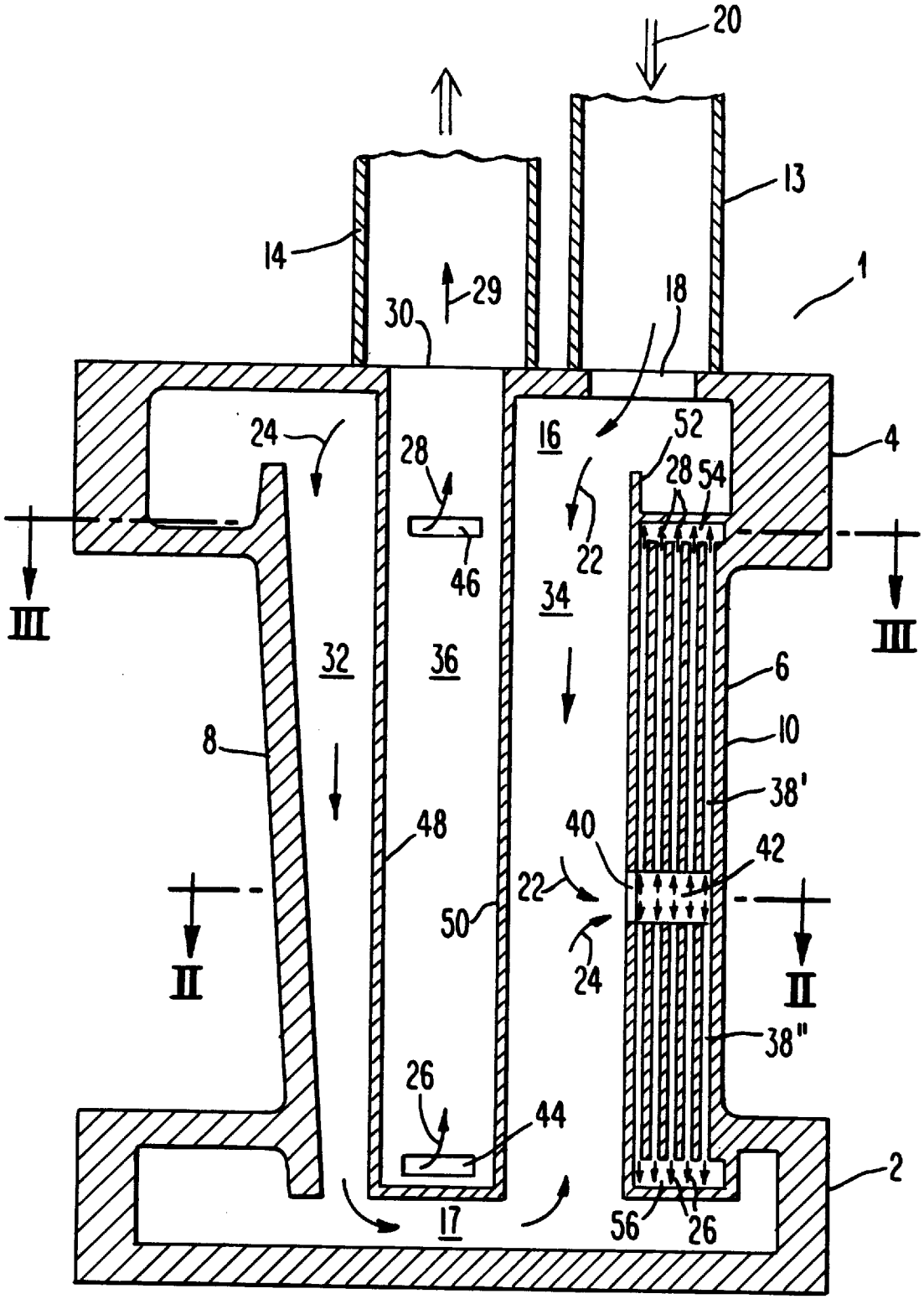
FIG. 1 is a longitudinal cross-section through a gas turbine vane of the current invention.

Referring to the drawings, there is shown in FIGS. 1–4 a vane 1 having an airfoil according to the current invention for use in the turbine section of a gas turbine. The vane 1 is comprised of an airfoil 6 having an inner shroud 2 on one end and an outer shroud 4 on the other end. As shown best in FIG. 2, the airfoil portion 6 of the vane 1 is formed by opposing side walls 9 and 11 that meet to form a leading edge 8 and a trailing edge 10. The current invention concerns an apparatus for cooling the airfoil 6, preferably the portion of the airfoil adjacent the trailing edge 10.

The major portion of the airfoil 6 is hollow. Transversely extending ribs 48, 50, and 52 divide the hollow interior of the airfoil 6 into three cooling air passages 32, 34, and 36. The first passage 32 is a cooling air supply passage and is formed in the portion of the airfoil 6 adjacent the leading edge 8. The second passage 34 is also a cooling supply passage but is formed in the vicinity of the trailing edge 6. A passage 17 in the inner shroud 2 connects the passages 32 and 34. The third passage 36 is formed in the mid-chord region of the airfoil 6 and forms a cooling air discharge passage.

Referring to FIG. 1, a cooling fluid supply pipe 13 is connected to the outer shroud 4. An opening 18 in the outer shroud 4 allows the supply pipe 13 to communicate with a passage 16 formed within the outer shroud. The outer shroud passage 16 is connected to passages 32 and 34 in the airfoil 6.

Figure 2:
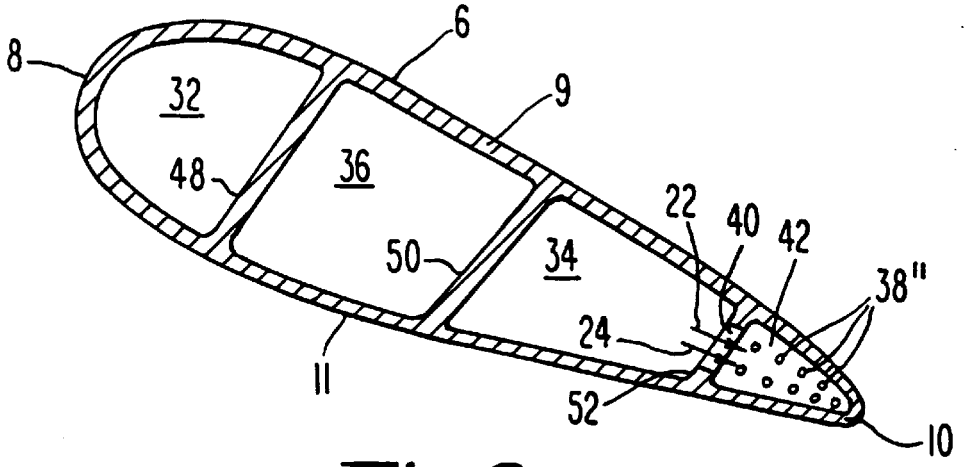
FIG. 2 is a is transverse cross-section taken through line II—II shown in FIG. 1.
Figure 4:
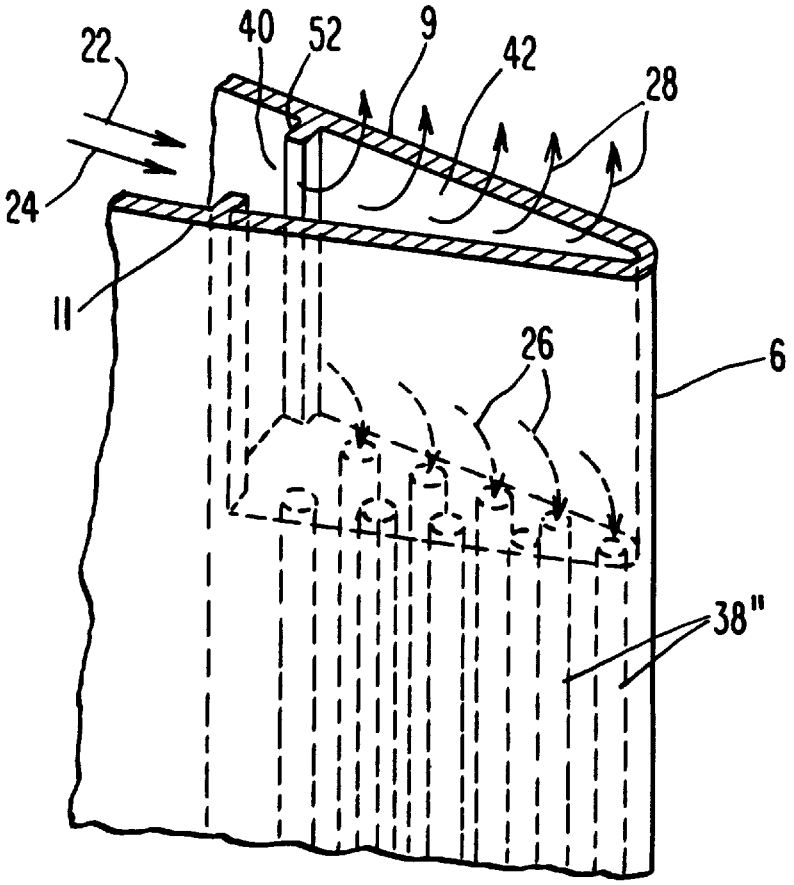
FIG. 4 is an isometric view of a portion of the trailing edge of the vane shown in FIG. 1 in the vicinity of the plenum.

As shown best in FIGS. 2 and 4, according to an important aspect of the current invention, a cavity 42 is formed between the side walls 9 and 11 that acts as a plenum. The plenum 42 is preferably located at approximately mid-height and adjacent the trailing edge 10 of the airfoil 6. An opening 40 in the rib 52 connects the plenum 42 with the supply passage 34.

Figure 3:
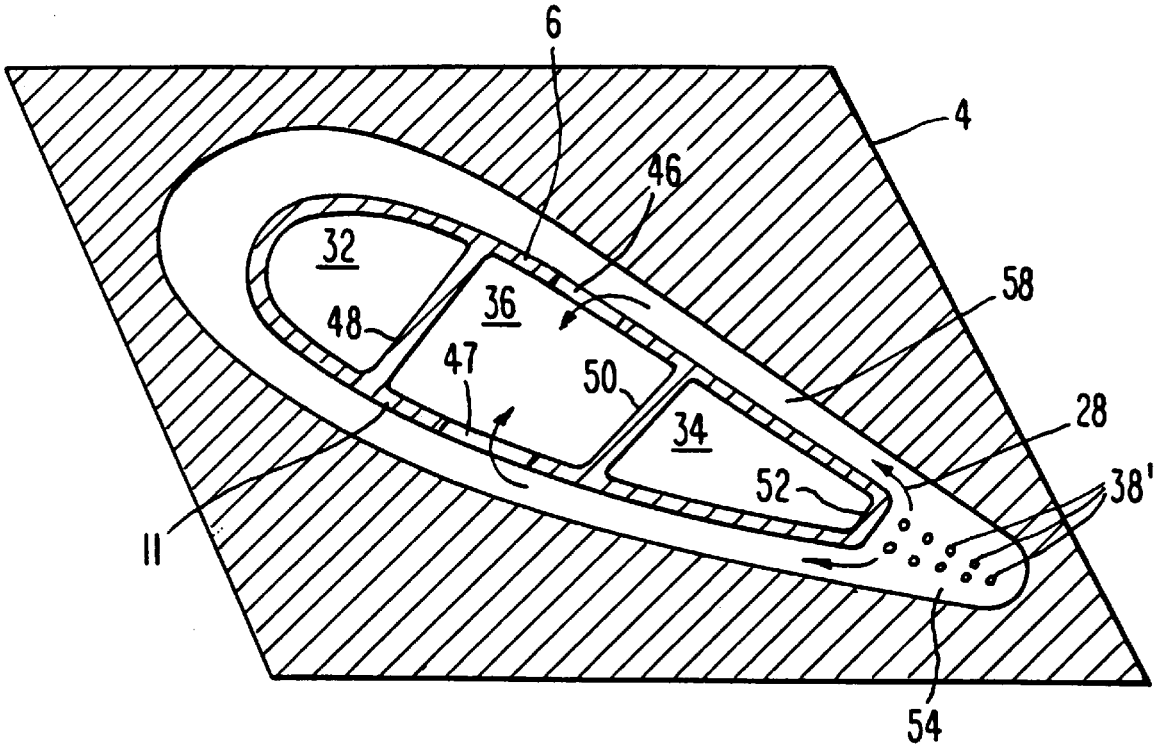
FIG. 3 is a is transverse cross-section taken through line III—III shown in FIG. 1.

As shown best in FIGS. 1 and 3, a first array of cooling fluid holes 38' extend radially outward from the plenum 42 to a cooling fluid manifold 54 formed in the outer shroud 4, with the inlets to the holes being at the plenum and the outlets being at the manifold. As shown in FIG. 3, a passage 58 is formed in the outer shroud 4 that extends generally perpendicularly to the radial direction. The passage 58 extends from the manifold 54 around the portion of the airfoil 6 projecting into the outer shroud. Openings 46 and 47 are formed in the portions of the side walls 9 and 11, respectively, that extend into the outer shroud 4. The openings 46 and 47 allow the passage 58 to communicate with the discharge passage 36. As shown in FIG. 1, an outlet 30 is formed in the discharge passage 36 and is connected to a return pipe 14.

As shown best in FIGS. 1, 2 and 4, a second array of cooling fluid holes 38", which are preferably radially aligned with the cooling fluid holes 38', extend radially inward from the plenum 42 to a cooling fluid manifold 56 formed in the inner shroud 2, with the inlets to the holes being at the plenum and the outlets being at the manifold. A passage (not shown), similar to passage 58 in the outer shroud 4, is formed in the inner shroud 2 that extends from the manifold 56 around the portion of the airfoil 6 projecting into the inner shroud. Openings 44, one of which is shown in FIG. 1, which are similar to openings 46 and 47 at the outer shroud 4, are formed in the portions of the side walls 9 and 11, respectively, that extend into the inner shroud 2. The openings 44 allow the passage in the inner shroud 2 to communicate with the discharge passage 36.

It should be understood that the inner and outer shrouds may contain cooling passages, in addition to those connecting the trailing edge cooling fluid manifolds 54 and 56 to the discharge passage 36, that aid in the cooling of the shrouds themselves. However, such shroud cooling is not part of the current invention, which concerns the cooling of the airfoil 6 and, preferably, the portion of the airfoil adjacent the trailing edge 10.

In operation, cooling fluid, which in the preferred embodiment is compressed air 20, typically bled from the compressor section of the gas turbine, is directed to the vane outer shroud 4 by the supply pipe 13, as shown in FIG. 1. According to a preferred embodiment of the invention, the vane 1 has cooling passages that are part of a closed loop cooling air system. Thus, essentially all of the cooling air supplied to the vane 1 is returned to the cooling system.

Upon flowing through the opening 18 and entering the passage 16 in the outer shroud 4, the cooling air 20 is divided into two streams 22 and 24. The first cooling air stream 22 flows radially inward through the trailing edge supply passage 34 to the plenum 42 and, in so doing, cools a portion of the side walls 9 and 11 of the airfoil 6.

The second cooling air stream 24 flows radially inward through the leading edge supply passage 32 and cools the leading edge 8 portion of the airfoil 6. The passage 17 in the inner shroud 2 then directs the cooling air 24 from the passage 32 to the passage 34, where it flows radially outward (that is, toward the outer shroud 4) to the plenum 42. In the plenum 42, the cooling air streams 22 and 24 combine and are then divided into numerous small streams by the trailing edge cooling holes 38. As shown best in FIGS. 2 and 4, the plenum is tapered as it extends in the axial direction toward the trailing edge 10 of the airfoil 6. Such tapering provides the area reduction necessary for uniform flow distribution among the cooling holes 38.

A portion 28 of the combined flow of cooling air 22 and 24, flows radially outward (that is, toward the outer shroud 4) from the plenum 42 through the holes 38' to the manifold 54, thereby providing vigorous cooling of the approximately upper half portion of the airfoil 6 adjacent the trailing edge 10 that is located above the plenum 42. In the manifold 54, the individual streams of cooling air 28 are collected and are then directed by passage 58 to the openings 46 and 47, as shown in FIG. 3. From the openings 46 and 47, the cooling air 28 enters the discharge passage 36 and flows radially outward to the exhaust pipe 14, as shown in FIG. 1.

Similarly, a portion 26 of the combined flow of cooling air 22 and 24, flows radially inward from the plenum 42 through the holes 38" to the manifold 56, thereby providing vigorous cooling of the approximately lower half portion of the airfoil 6 adjacent the trailing edge 10 below the plenum 42. In the manifold 56, the individual streams of cooling air 26 are collected and are then directed by the inner shroud passage to the openings 44, as discussed above with respect to the outer shroud 4. From the openings 44, the cooling air 26 enters the discharge passage 36 and flows radially outward to the exhaust pipe 14 and, in so doing, cools the mid-chord portion of the side walls 9 and 11 of the airfoil 6. In the preferred embodiment of the invention, the exhaust pipe 14 directs the cooling air 29 to a cooler for recycling back to the turbine.

The present invention has numerous advantages over traditional airfoil cooling schemes. First, since the length of the cooling air passages 38 is effectively cut in half, compared to span-wise holes that extend from the inner shroud to the outer shroud, there is less chance of overheating the coolant, which may be air or steam, for example, by the time it reaches a shroud. Also, the pressure drop through the passages 38 is reduced, thereby allowing the use of holes 38 of minimum diameter. Small diameter holes permit the use of a thin trailing edge 10, which has aerodynamic advantages. The airfoil 6 is also easier to manufacture since long runs of cooling holes are avoided.

Although the current invention has been discussed in connection with the airfoil for a stationary vane in a gas turbine, the invention is also applicable to other types of components. In addition, although the invention has been discussed with reference to a closed loop cooling system utilizing compressed air, the invention is also applicable to more conventional open loop systems as well as to systems using other types of cooling fluids, such as steam. Thus, the present invention may be embodied in other specific forms without departing from the spirit or essential attributes thereof and, accordingly, reference should be made to the appended claims, rather than to the foregoing specification, as indicating the scope of the invention.

We claim:

1. An airfoil for a turbomachine, comprising:

a) a leading edge and a trailing edge;

b) first and second ends, said first end disposed radially outward from said second end;

c) first and second side walls;

d) a first passage formed between said first and second sidewalls, said first passage having an inlet for receiving a flow of a cooling fluid directed to said airfoil;

e) a plenum formed between said side walls and disposed between said first and second ends, said plenum in flow communication with said first passage;

f) a plurality of second passages in flow communication with said plenum, said second passages extending in a substantially radial direction from said plenum toward said first end; and g) a plurality of third passages in flow communication with said plenum, said third passages extending in a substantially radial direction from said plenum toward said second end.

2. The airfoil according to claim 1, wherein said plenum is disposed adjacent said trailing edge approximately midway between said first and second ends.

3. The airfoil according to claim 1, wherein said second and third passages form an array of passages disposed adjacent said trailing edge.

4. The airfoil according to claim 1, further comprising a first manifold for collecting cooling fluid discharged from said second passages.

5. The airfoil according to claim 1, further comprising an outlet for discharging said cooling fluid from said airfoil, and means for directing said cooling fluid collected by said first manifold to said airfoil outlet.

6. The airfoil a according to claim 5, wherein said fluid directing means comprises a fourth passage in flow communication with said first manifold.

7. The airfoil according to claim 6, further comprising a first shroud affixed to one of said ends, and wherein said fourth passage is formed in said first shroud.

8. The airfoil according to claim 6, wherein said fourth passage extends in a direction substantially perpendicular to the radial direction.

9. The airfoil according to claim 6, further comprising a fifth passage formed between said first and second walls.

10. The airfoil according to claim 9, further comprising a rib extending between said first and second sidewalls and separating said fifth passage from said first passage.

11. The airfoil according to claim 9, wherein said fourth passage is disposed so as to place said first manifold in flow communication with said fifth passage.

12. The airfoil according to claim 7, further comprising:

a) a second manifold for collecting cooling fluid discharged from said third passages;

b) second cooling fluid directing means for directing said cooling fluid collected by said second manifold to said airfoil outlet.

13. The airfoil according to claim 12, wherein said second cooling fluid directing means comprises a fifth passage in flow communication with said second manifold, and further comprising a second shroud affixed to the other one of said ends, said fifth passage formed in said second shroud.

14. The airfoil according to claim 1, wherein said airfoil is part of a stationary vane.

15. A gas turbine vane, comprising:

a) a leading edge and a trailing edge;

b) first and second sidewalls;

c) inner and outer shrouds;

d) a cavity disposed between said first and second sidewalls, said cavity having an inlet for receiving a flow of cooling fluid directed to said airfoil;

e) a plenum disposed between said cavity and said trailing edge approximately midway between said inner and outer shrouds, an opening formed between said plenum and said cavity;

f) a first plurality of passages formed in an array adjacent said trailing edge, said first plurality of passages extending in a substantially radially outward direction from said plenum to said outer shroud; and g) a second plurality of passages formed in an array adjacent said trailing edge, said second plurality of passages extending in a substantially radially inward direction from said plenum to said inner shroud.

16. The vane according to claim 15, further comprising:

a) first and second manifolds formed in said inner and outer shrouds, respectively;

b) said first plurality of passages extending between said plenum and said first manifold; and c) said second plurality of passages extending between said plenum and said second manifold.

17. The vane according to claim 16, further comprising:

a) means for discharging said cooling fluid from said vane; and b) third and fourth passages for placing said first and second manifolds, respectively, in flow communication with said cooling fluid discharge means.

* * * * *

UNITED STATES PATENT AND TRADEMARK OFFICE

CERTIFICATE OF CORRRECTION

PATENT NO. : 5,813,827 
DATED : September 29, 1998
INVENTOR(S) : Raymond Scott Nordlund, et al It is certified that error appears in the above-identified patent and that said Letters Patent is hereby corrected as shown below:

On the title page, item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 4 | 2 | 0 | 5 | 0 | 2 | 1/7/69 | Howald | | | |
| | | 5 | 4 | 6 | 4 | 3 | 2 | 2 | 11/7/95 | Cunha et al. | | | |
| | | 2 | 8 | 4 | 7 | 1 | 8 | 5 | 8/12/58 | Petrie et al. | | | |
| | | | | | | | | | | | | | |

UNITED STATES PATENT AND TRADEMARK OFFICE

CERTIFICATE OF CORRRECTION

PATENT NO. : 5,813,827
DATED : September 29, 1998
INVENTOR(S) : Raymond Scott Nordlund, et al It is certified that error appears in the above-identified patent and that said Letters Patent is hereby corrected as shown below:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 9 | 6 | 0 | 0 | 7 | 1 | A | 6/10/64 | GB | | | | |
| | | 6 | 8 | 0 | 0 | 1 | 4 | A | 10/1/52 | GB | | | | |
| | | 6 | 0 | 1 | 9 | 8 | 3 | 05A | 10/7/85 | Japan | | | | |
| | | | | | | | | | | | | | | |

Signed and Sealed this

Thirteenth Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,813,827

DATED : September 29, 1998

INVENTOR(S) : R. S. NORLUND et al.

It is certified that error appears in the above-identified patent and that said Letters Patent is hereby corrected as shown below:

Column 1, line 3, the following should be inserted as a new paragraph:

This invention was made with government support under Contract DE-FC-21-95-MC32267 awarded by the DOE. The government has certain rights in this invention. --

Signed and Sealed this

Eighth Day of February, 2000

*Attest:*

*Attesting Officer*

Q. TODD DICKINSON

*Commissioner of Patents and Trademarks*